United States Patent [19]

Katada et al.

[11] 4,368,885

[45] Jan. 18, 1983

[54] SPRING TYPE BALL EMITTING APPARATUS

[75] Inventors: Masayasu Katada; Yuko Imai, both of Atsugi; Tsugio Hirabayashi, Tokyo, all of Japan

[73] Assignee: Sony Corporation, Tokyo, Japan

[21] Appl. No.: 206,375

[22] Filed: Nov. 13, 1980

[30] Foreign Application Priority Data

Apr. 4, 1980 [JP] Japan ..... 55-44123

[51] Int. Cl.[3] ..... F41B 7/00

[52] U.S. Cl. ..... 273/29 A; 318/484; 124/16; 124/36

[58] Field of Search ..... 124/16, 17, 36, 41 R, 124/47, 32; 318/484; 273/29A, 26 D

[56] References Cited

U.S. PATENT DOCUMENTS

| | | | |
|---|---|---|---|
| 3,977,386 | 8/1976 | Meyer | 124/36 X |
| 4,185,608 | 1/1980 | Young et al. | 124/16 |
| 4,209,004 | 6/1980 | Kennedy | 124/16 |

*Primary Examiner*—Richard C. Pinkham
*Assistant Examiner*—William R. Browne
*Attorney, Agent, or Firm*—Hill, Van Santen, Steadman, Chiara & Simpson

[57] ABSTRACT

A tennis practicing machine is disclosed which has a rotating arm for periodically projecting a tennis ball towards a player. A spring connected to the rotating arm stores a rotating force which is periodically released as the rotating arm passes a predetermined point causing ball emission. A power source control system is provided which controls rotation of the motor such that in order to insure safe operation of the machine, when the machine is turned off a ball is emitted if the rotating arm is within a predetermined range near the point of ball emission. Accordingly accidental jarring or vibration of the machine does not cause accidental emission of a ball. Also, the system provides a delay for starting emission of the ball when the machine is first turned on, and furthermore circuitry is provided to maintain a constant time period of operation regardless of power main frequencies of 50 or 60 Hz.

9 Claims, 8 Drawing Figures

SPRING TYPE BALL EMITTING APPARATUS

BACKGROUND OF THE INVENTION

1. Field of the Invention

The invention relates to a ball emitting apparatus and more particularly to a tennis practicing machine.

2. Description of the Prior Art

It is known to provide a tennis practicing machine of the type shown in FIG. 1 of the drawings. A ball retrieval net 1 is positioned to collect balls which are hit at it by a student practicing tennis. The net 1 has a substantially vertical curtain 3*f* suspended from a horizontal crossbar 2. The vertical portion 3*f* terminates short of a base netting 3*b* which is slanted in a funnel-like fashion towards the aperture 6 of the machine or apparatus 5. The net 1 also has a back portion 3*e* and side portions 3*d* and 3*g*. A front apron 3*a* is also provided tied to a lower crossbar 2*f*.

The upper horizontal bar 2 is supported by two legs 2*c* and 2*d* or 2*a* and 2*b* at respective ends of the bar 2. Slant supporting bars 2*h* and 2*g* are also provided from respective legs 2*d* and 2*c*.

In front of the aperture 6 a front netting 3*a* is arranged above which balls entering the net 1 must pass.

As a ball is hit by a tennis player into the netting 1, it falls onto the netting floor portion 3*b* and is funneled into the tube 7 of machine 5 at aperture 6.

A window 4 is provided in netting portion 3*a* through which balls are emitted from the machine 5.

Consequently, with the practicing machine described, a tennis player hits the balls projected from machine 5 into the netting 1 where they are "recycled" back into machine 5 for repetitive emission.

With the system described above, a tennis emitting machine 5 such as shown in FIG. 2 preferably has an auxiliary power switch 20 so as to allow an operator to initiate operation of the system from a distance. A window 10 is provided in the apparatus 5 through which the balls 9 are emitted.

As shown in FIG. 3, the prior art machine has a drive motor 16 connecting through gearing 15 to a rotating arm 13 on a shaft 14. A spring 17 stores energy as the arm 13 rotates until the arm 13 reaches a predetermined point during rotation in the direction a at which time the arm 13 suddenly rapidly accelerates so as to project a ball 9 in well-known fashion. A guide 12 guides the tennis balls 9 to the point of projection. A slip clutch of well known design permits the arm 13 to rotate forward free of gear 15 when the spring 17 rapidly rotates arm 13.

A base 18 is mounted on a chassis 11 to provide a mounting wall for the rotating arm 13.

Rotating arm 13 has a longer portion 13*b* opposite the peg 13*a* so that said longer portion will strike the ball a half rotation after peg 13*a* passes the ball.

With the above-described system, there is the disadvantage that if the machine is shut off, the arm 13 may come to rest near its trigger point for ball emission. In other words, the spring 17 will be stretched to the point of maximum energy storage. If the tennis ball emission machine 5 were accidentally jostled, it is possible that a ball can be accidentally emitted and strike an unwary player.

There is also the disadvantage that when the machine is set in operation that a ball will be emitted before the tennis player is ready for hitting.

An additional disadvantage of the known system is that when the machine is plugged into a power main having a power line frequency of 50 Hz rather than 60 Hz, that the machine will operate over an undesirably slower time period.

SUMMARY OF THE INVENTION

It is an object of the invention to provide an improved ball emitting apparatus in a tennis practicing system which has safety features incorporated therein including prevention of accidental projection of a ball which might strike an unsuspecting user.

It is another object of the invention to provide a ball emitting apparatus which can emit a ball constantly, regardless of the power frequency.

It is a further object of the invention to delay initial projection of a ball when the machine is first activated.

It is a further object of the invention to provide a ball emitting apparatus which can change the angle of emitting a ball.

It is another object of the invention to solve the above objectives with minimum component cost.

According to the invention, a ball emitting apparatus of the type previously described is provided with a detector means for detecting a predetermined rotating range of the rotating arm which begins prior to and is inclusive of a predetermined point at which the arm is accelerated by the spring to emit the ball. A power source control means controls the motor in conjunction with the detector such that when the power switch is opened for the machine, the motor continues to rotate if the detector detects that the rotating arm is positioned in the predetermined rotating range. Accordingly, the last ball is emitted and the arm is left in a more stable state for which there is no danger of accidental ball emission.

Furthermore, with the invention a delay circuitry is provided which delays emitting of the ball for a predetermined time when the power switch is turned on.

In accordance with another aspect of the invention, the power source control includes circuitry for controlling a time period for a complete rotation of the arm regardless of whether the power line source is 50 to 60 Hz. Finally, with the invention a rotatable base plate is provided to permit projection of the ball at various angles.

DESCRIPTION OF THE PREFERRED EMBODIMENTS

Figure 1:
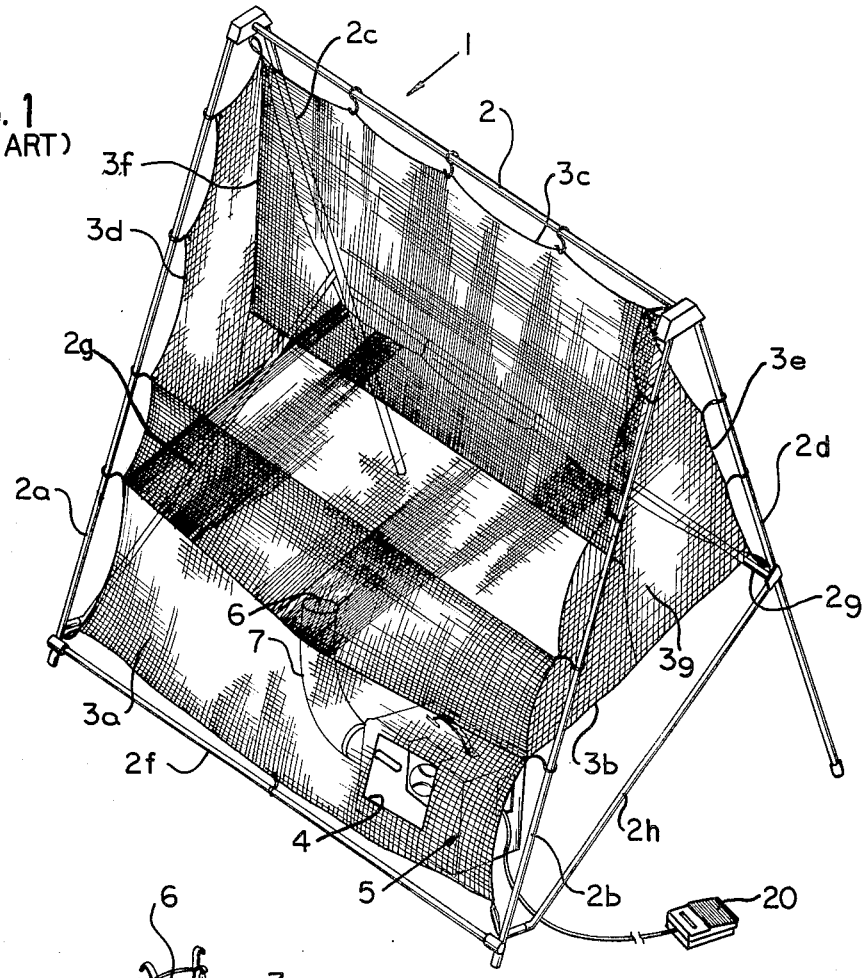
FIG. 1 ( PRIOR ART )
FIG. 1 is a perspective view showing a tennis practicing machine having a ball emitting apparatus.
Figure 2:
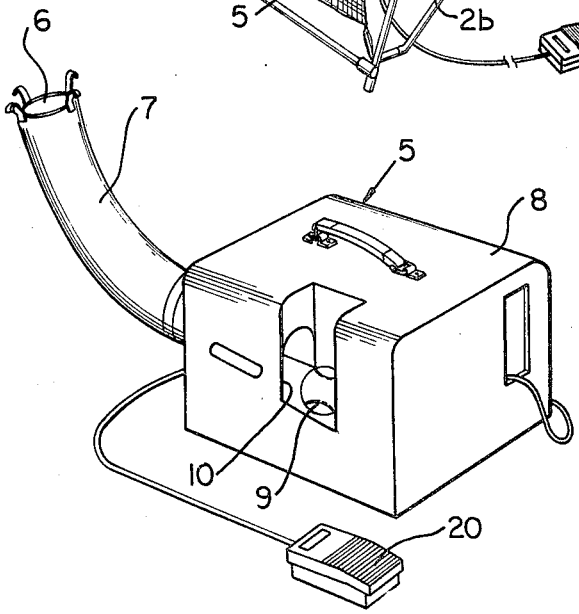
FIG. 2 ( PRIOR ART )
FIG. 2 is a perspective view of the ball emitting apparatus.
Figure 3:
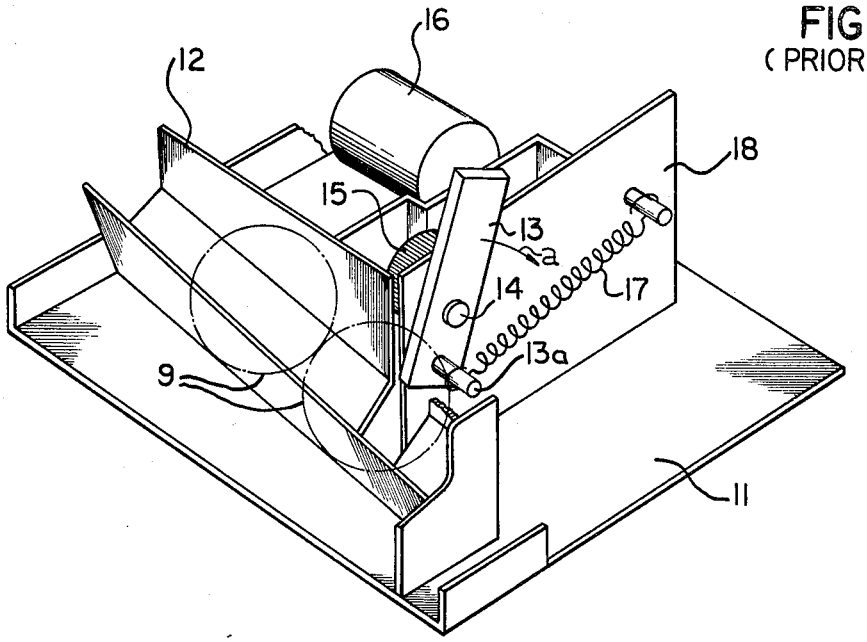
FIG 3 (PRIOR ART)
FIG. 3 is a schematic perspective view of an interior of the ball emitting apparatus.

The operation of the ball retrieval net 1 in combination with the ball emitting apparatus 5 has been previously described with respect to FIGS. 1, 2 and 3.

Figure 4:
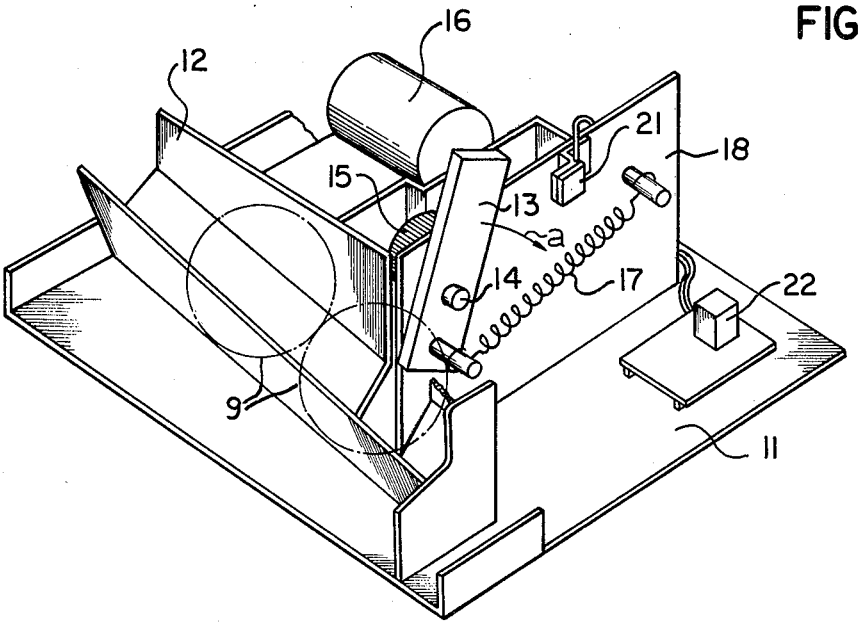
FIG. 4 is a perspective view showing the mechanism of the ball emitting apparatus according to the present invention.

According to the present invention as shown in FIG. 4 there are provided detecting means 21 for detecting the specific rotary position of the rotary arm 13, which will emit the ball 9 in connection therewith, and a power source control circuit for the drive motor 16 of the rotary arm 13 which includes control means 22 for controlling the drive motor 16 based upon the signal from the detecting means 21.

The detecting means 21 may be formed of, for example, a micro-switch located in the rotating path of the rotary arm 13. When the rotary arm 13 is rotated to such a rotary position where the rotary arm 13 expands the abovementioned spring mechanism, for example coiled spring 17, the spring stores the maximum biasing force therein. Maximum force is stored when both ends of the spring 17 which are respectively fixed to the rotary arm 13 and fixed part 18, and the rotary shaft 14 of the rotary arm 13 are located in a line (which will be hereinafter referred to as a dead point or toggle point). When the arm is in an unstable rotary range which includes the deadpoint, (the arm may be triggered by a sudden impact or vibration as described previously), the rotary arm 13 contacts the contact piece of the micro-switch 21 directly or indirectly to, for example, close the micro-switch 21.

Figure 5:
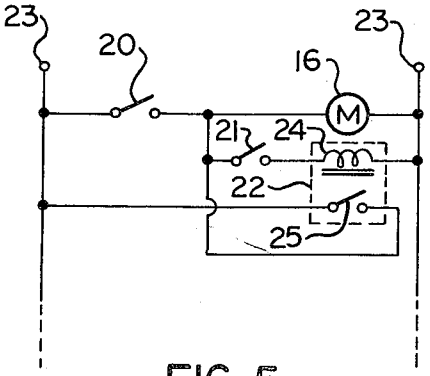
FIG. 5 is a circuit diagram showing the fundamental construction of the power source control circuit for the drive motor used in the apparatus of FIG. 3.

FIG. 5 shows an example of the fundamental structure of the power source control circuit for the drive motor 16. In FIG. 5, 23 designates power source terminals and 20 a power source switch which is connected in series to the motor 16 between the power source terminals 23. A series connection of the micro-switch 21, which serves to detect the rotary position of the rotary arm 13, and a coil 24 of an electro-magnetic relay serving as the control means 22, is connected in parallel to the motor 16. 25 designates a switch or contact of the electro-magnetic relay 22 which is closed to an "ON" position by the current flowing through the coil 24 but opened or made "OFF" when the coil 24 is not energized. Further, this switch 25 is connected in parallel to the power source switch 20.

According to the above power source control circuit, when the power source switch 20 is closed, the motor 16 is connected to the power source terminals 23 and hence driven. The rotary arm 13 is rotated in the direction of the arrow a to enhance the biasing force of the spring 17. Thereafter, when the rotary arm 13 rotates past the dead point, it is rotated abruptly by the biasing force of the spring 17 to emit the ball 9 as described above. During the period in which the power source switch 20 is closed and the motor 16 is driven as set forth above, the balls 9 are emitted at a given interval. When the power source switch 20 is opened so as to stop the emitting of balls 9, if the micro-switch 21 is in its open state, the power supply to the motor 16 is stopped, the motor 16 is stopped, and consequently the emitting of balls 9 is stopped. However, when as described above the rotary arm 13 is in its unstable rotary range and the micro-switch 21 is closed, if the power source switch 20 is closed the relay coil 24 is energized and hence the relay contact 25 is closed. Therefore, even if the power source switch 20 is opened, when the rotary arm 13 is in its unstable rotary range so as to stop the emitting of balls 9, the motor 16 is still driven through the closed circuit from the power source terminal 23 through the relay contact 25 and motor 16 to the power source terminal 23. During the period when the rotary arm 13 is in its unstable rotary range, since the micro-switch 21 is held in its closed state, a circuit is completed from the power source terminal 23, the relay contact 25, micro-switch 21, relay coil 24 and to the power source terminal 23. Thus, the relay coil 24 is held in its energized state and hence the contact 25 is kept in its closed state. Therefore the motor 16 is still driven in this period and the rotary arm 13 is rotated beyond the dead point to emit the final ball 9. When the rotary arm 13 is rotated beyond the above unstable rotary range and beyond the dead point, the micro-switch 21 is released from the contact with the rotary arm 13 and then opened. The relay coil 24 then is de-energized, the contact 25 is opened, the power supply to the motor 16 is stopped and the rotary arm 13 is stopped in its stable range where no ball can be emitted any more as a result of accidental vibration or shock.

Figure 6:
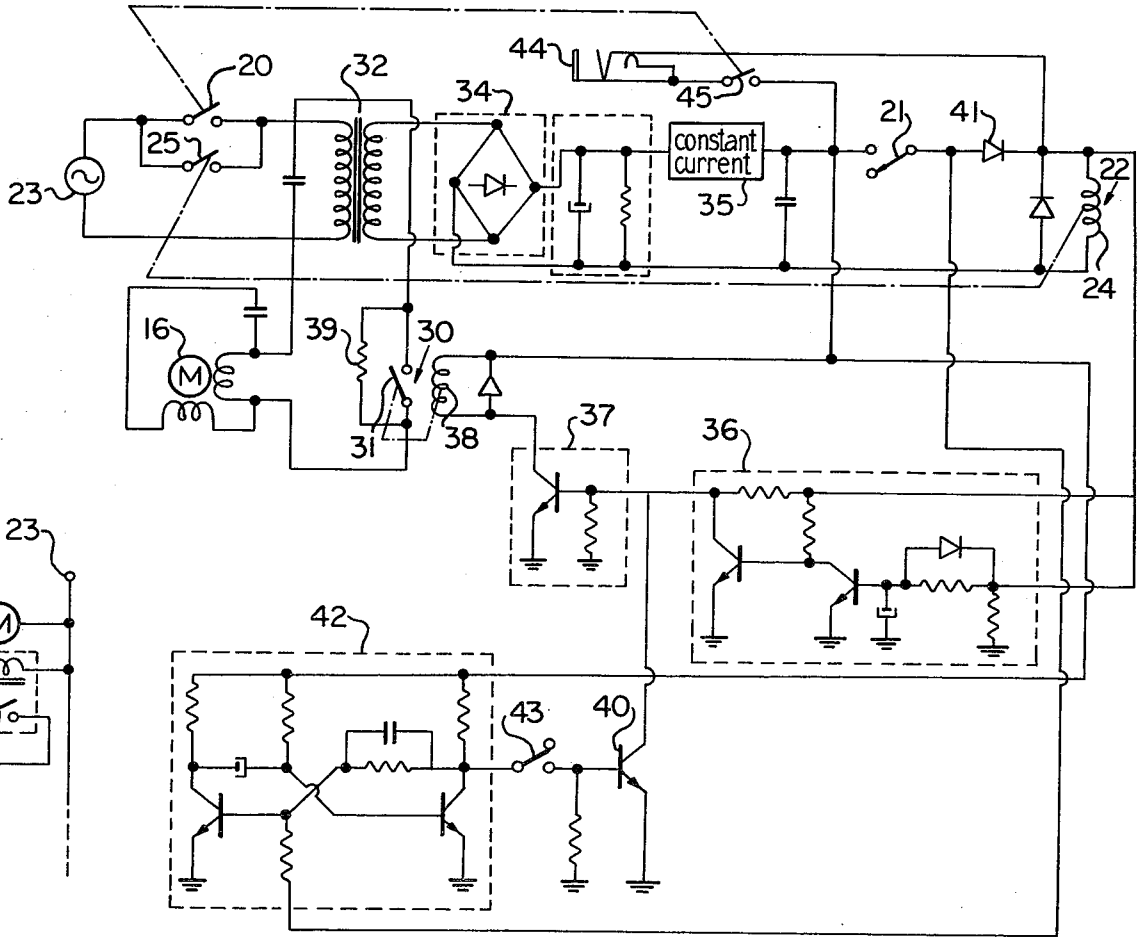
FIG. 6 is a circuit diagram showing an example of the actual power source control circuit employed in the invention.

FIG. 6 is a practical connection diagram of the power source control circuit for the motor 16, provided as an AC induction motor. In this example, a function is provided that when the power source switch 20 is opened or made OFF, the rotary arm 13 for emitting the ball 9 can be stopped at a stable state after the ball 9 is emitted completely. Also a function results that when the power source switch 20 is closed (ON), a risk is avoided that the ball 9 will be emitted and either strike the user or be wasted before a user is ready for hitting. In other words, the ball emitting is initiated after a predetermined period from the time when the power source switch 20 is switched ON.

Also with the invention, even when a frequency of the power source is changed from 50 Hz to 60 Hz, the interval between the sequentially emitted balls can be made constant.

In the example of FIG. 6, the motor 16 is connected to the power source 23 through the power source switch 20 and a relay contact 31 of another electro-magnetic relay 30. In this case, the relay contact 25 of the electro-magnetic relay 22 serving as the control means is connected in parallel to the power switch 20. The power source 23 is connected through the parallel connection of the power source switch 20 and relay contact 25 to the primary side of a transformer 32, whose secondary side is connected with the coil 24 of the electro-magnetic relay 22 through a rectifier circuit 33, a smoothing circuit 34, a constant current circuit 35, the micro-switch 21 (serving as the means for detecting the rotary position of the rotary arm 13), and an inverse current blocking diode 41. The primary of transformer 32 also connects with a coil 38 of the electro-magnetic relay 30 through a delay circuit 36 and a switching circuit 37. A resistor 39 with a predetermined resistance value is connected between both ends of the relay contact 31 of the coil 38. A shunt transistor 40 is connected between the connection point of the delay circuit 36 and switching circuit 37 and ground. A mono-multivibrator 42 is provided which is triggered by the voltage at the connection between the micro-switch 21 and the diode 41, whose output is connected to the base of the shunt transistor 40 through the open and close switch 43. A jack 44 is provided for connecting a remote control switch between the connection point of the constant current circuit 35 to the micro-switch 21 and the connection point of the relay 22 to the diode 41.

A switch 45 is inserted into the path of the jack 44 which is opened and closed in ganged relation with the power source switch 20.

With the circuit of FIG. 6, when the power source 33 is the commercial power source of 50 Hz, the switch 43 is kept open. Under this state, if the power source switch 20 and hence switch 45 are closed, the relay 22 is energized to close its switch or contact 25. Also, the switching circuit 37 becomes conductive after a given delay time by the delay circuit 36. Thus, the relay 30 is energized to close its contact 31, so that the motor 16 is driven and the rotary arm 13, which is described in connection with FIG. 4, is rotated to start the ball emitting. That is, after a given time from the power source switch 20 being closed, the ball emisson is initiated. When the power source switch 20 and hence switch 45 are opened, if the micro-switch 21 is open, the power supply to the coil 24 of the relay 22 is cut off. Therefore, the contact 25 is also open and hence the motor 16 is stopped. However, upon switch 20 being opened, if the rotary arm 13 is in its unstable rotary range described above and accordingly the micro-switch 21 is closed, the relay 22 is energized and hence the contact 25 is still closed. Therefore, even if the switches 20 and 45 are opened, the motor 16 is maintained in rotation until the rotary arm 13 arrives at its stable rotary position where the micro-switch 21 is opened.

When the power source 23 is the commercial power source of 60 Hz, the switch 43 is closed. Under this condition, when the switches 20 and 45 are closed, similar to the above case, the motor 16 is driven after the given time from the closing of switches 20 and 45 and the rotary arm 13 is rotated to emit the ball. In this case, according to the rotation of the rotary arm 13, the micro-switch 21 is switched ON and OFF. At this time, the mono-multivibrator 42 is triggered by the voltage appearing at the connection point between the switch 21 and the diode 41 to supply its output to the shunt transistor 40. Thus, transistor 40 is periodically made conductive in a given period to make the switching circuit 37 non-conductive. Therefore, the relay 30 is periodically de-energized in the given period to open the switch or contact 31 and hence the motor 16 is periodically stopped or paused. Accordingly, even in the case where the power source 23 is 60 Hz, due to the existence of the above pause period, the rotating speed of rotary arm 13 can be made substantially the same as that of 50 Hz, and hence the interval between the ball emissions can be made constant in both cases.

In the above circuit construction, since resistor 39 is connected in parallel to the relay contact 31, by suitably selecting the resistance value of resistor 39, in the period in which contact 31 is opened, for example in the above pause period, current is passed which provides sufficient rotating force in motor 16 so that it may not be rotated in the reverse direction by the biasing force of spring 17.

Figure 7:
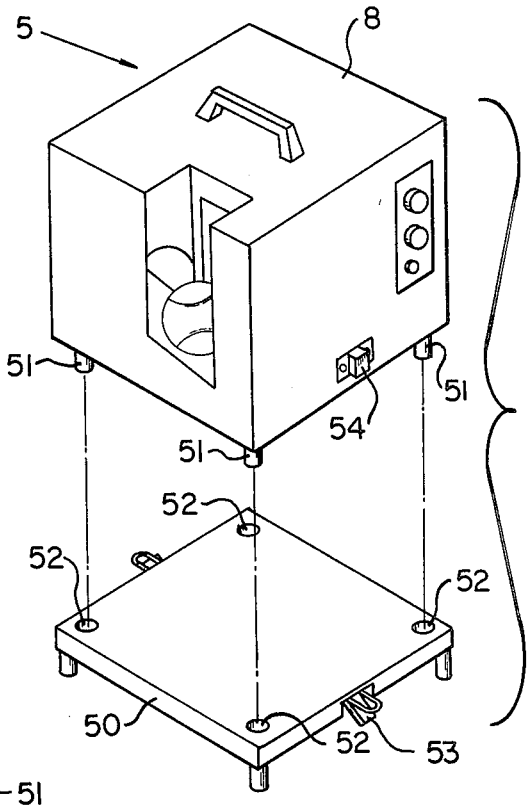
FIGS. 7 and 8 are respectively exploded diagrams of examples of the ball emitting apparatus.

In practice, the ball emitting apparatus 5 is installed under the net arrangement 1 as described in connection with FIG. 1. In order to carry out ball emission in a stable manner, it is preferred that the apparatus 5 is made as heavy as possible. It is, however, desired that in view of the need to install apparatus 5 under the net arrangement 1, apparatus 5 is made as light as possible. To this end, as shown in FIG. 7, the case 8 of apparatus 5 is detachably assembled to a base 50 which is formed separately from the case 8 and is made heavy. In this case, for example, positioning projections 51 and apertures 52 are respectively provided on the bottom surface of the case 8 and the base 50 for assembling them in position. Also, a so-called punch lock 53 and a receiver member 54 are respectively provided on either of them to mechanically couple them together.

Figure 8:
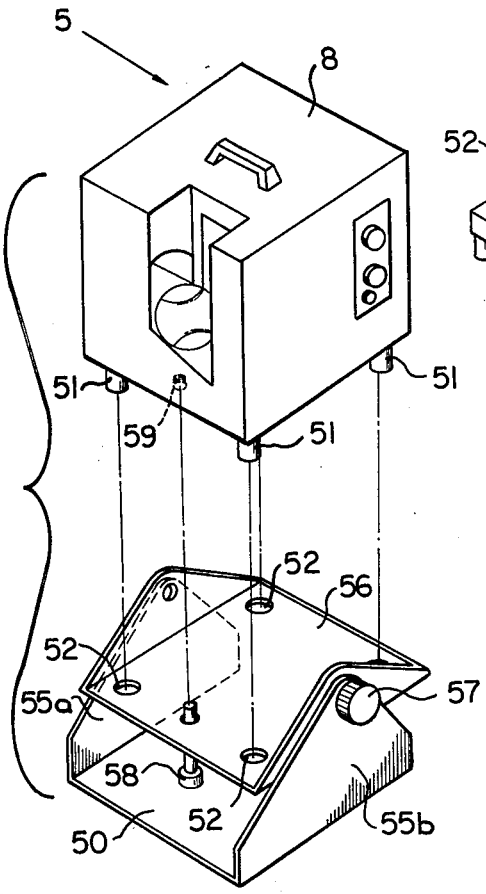

FIG. 8 shows another example of the case or housing and base. In this example, facing side plates 55*a* and 55*b* are integrally provided on the opposing side edges of the heavy base 50 to rotatably support an attaching base plate 56 between them for the case 8. In this situation, the above positioning projections 51 and recesses or apertures 52 are located on either of the bottom surface of case 8 and base plate 56. A set-screw 57 is provided to hold the base plate 56 on the base 50 at a given rotary position, and a fixing screw 58 is meshed with a tapped hole 59 bored through the bottom surface of case 8 to attach the case 8 to the base plate 56.

With the structure shown in FIG. 8, since the case 8 is fixed to the base plate 56 which is rotatable on the base 50, the elevation angle of case 8 and hence emitting angle of the ball can be desirably selected.

When the heavy base 50 is used as described above, it is possible that the base 50 is set under the net arrangement 1, for example, at the given position and only the case 8, i.e. apparatus 5 proper, is detached from the base 50 to be housed. Thus, the apparatus proper can be light with the result that the apparatus can be easily handled.

Although various minor modifications may be suggested by those versed in the art, it should be understood that we wish to embody within the scope of the patent warranted hereon, all such embodiments as reasonably and properly come within the scope of our contribution to the art.

We claim as our invention:

1. A ball emitting apparatus, comprising:

(a) rotating arm means for emitting a ball;

(b) spring means connected to said rotating arm means for storing a rotating force to make said rotating arm means emit the ball when the arm means passes a predetermined point in its rotation;

(c) a motor connected to rotate said rotating arm means;

(d) detector means for detecting a predetermined rotating range of said rotating arm means before emitting the ball beginning prior to and inclusive of said predetermined point; and (e) power source control means for controlling the rotation of said motor and including a power switch for said motor and means for continuing rotation of the motor when said power switch is opened and said detector means detects that said rotating arm means is positioned in said predetermined rotating range, the control means stopping rotation of the arm means when the ball is emitted and the arm means is no longer in the predetermined range.

2. A ball emitting apparatus according to claim 1 further comprising delay means for delaying emitting of the ball for a predetermined time when the power switch is turned on.

3. An apparatus according to claim 1 wherein said power source control means includes means for controlling the motor such that a time period for a complete rotation of the arm means remains constant for 50 or 60 Hz.

4. A ball emitting apparatus according to claim 1 further including: means for collecting balls hit by a player and guiding them to a ball emission station containing said rotating arm means;

the rotating arm means including a rotating arm having a pivot point offset from a center thereof such that a longer portion of the arm is available to strike and emit the ball while a shorter portion connects with said spring means arranged to store a force as the rotating arm rotates until said predetermined point at which time the stored force of the spring causes rapid acceleration of the rotating arm so as to emit the ball;

said predetermined rotating range being dependent upon a desired safety factor to prevent accidental emission of a ball resulting from accidental disturbance of the rotating arm causing passage beyond the predetermined point;

said power switch being provided for turning the apparatus on and off; and said power control means continuing rotation of the rotating arm beyond the predetermined point so as to emit a last ball when the arm is within said predetermined range after turning the power switch to the off position.

5. The apparatus of claim 4 wherein delay means are provided for delaying actuation of the motor when the machine is first turned on for a predetermined period.

6. The apparatus of claim 4 wherein a switch is provided having a 50 Hz and a 60 Hz position, and circuit means are provided for temporarily shutting off power to the motor when the switch is in the 60 Hz position so as to equalize a time period of rotation for the rotating arm for 50 Hz as compared to 60 Hz.

7. The apparatus of claim 6 wherein said circuit means utilizes the sensor to initiate the temporary off time for the motor.

8. The apparatus of claim 4 wherein a base is provided with means for releasable attachment to the ball emitting apparatus.

9. The apparatus of claim 8 wherein a rotatable base plate means is provided on the base permitting adjustment of angle of the ball emitting apparatus such that balls can be selectively emitted at varying desired angles.

* * * * *